US006883433B2

(12) United States Patent
Stephan et al.

(10) Patent No.: US 6,883,433 B2
(45) Date of Patent: Apr. 26, 2005

(54) METHOD OF OPERATING A SHEET-FED PRINTING PRESS AND SHEET-FED PRINTING PRESS FOR IMPLEMENTING THE METHOD

(75) Inventors: Günter Stephan, Wiesloch (DE); Wolfgang Wolf, Walldorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/770,760

(22) Filed: Feb. 2, 2004

(65) Prior Publication Data

US 2004/0154491 A1 Aug. 12, 2004

(30) Foreign Application Priority Data

Jan. 31, 2003 (DE) ..... 103 03 880

(51) Int. Cl.[7] ..... B41J 13/24
(52) U.S. Cl. ..... 101/484; 101/232; 101/272
(58) Field of Search ..... 101/484, 232, 101/272, 216; 271/264

(56) References Cited

U.S. PATENT DOCUMENTS 5,082,270 A * 1/1992 Kamezaki ..... 271/109
6,135,026 A * 10/2000 Kalbantner et al. ..... 101/232
6,378,425 B1 4/2002 Stephan
2002/0069775 A1 6/2002 Knopp et al.

FOREIGN PATENT DOCUMENTS

| | | |
|---|---|---|
| DE | 195 03 110 A1 | 8/1996 |
| DE | 297 10 252 U1 | 10/1997 |
| DE | 199 14 178 A1 | 10/1999 |
| DE | 198 54 053 A1 | 5/2000 |
| DE | 100 60 557 A1 | 6/2002 |
| DE | 101 00 197 A | 7/2002 |

* cited by examiner

*Primary Examiner*—Charles H. Nolan, Jr.
(74) *Attorney, Agent, or Firm*—Laurence A. Greenberg; Werner H. Stemer; Ralph E. Locher

(57) ABSTRACT

A method of operating a sheet-fed printing press having a sheet guide module, removable from the sheet-fed printing press and then inserted back into the sheet-fed printing press again, and a machine control system, includes the steps of monitoring a position of the sheet guide module with respect to its correct operating position with the machine control system, and, based upon results of the position monitoring, the machine control system keeping the sheet-fed printing process in a first operating mode when the sheet guide module is located in the correct operating position, and keeping it in a second operating mode with at least one operating function that is restricted as compared with the first operating mode when the sheet guide module is out of the correct operating position. Also provided is a sheet-fed printing press suitable for carrying out the method.

30 Claims, 3 Drawing Sheets

METHOD OF OPERATING A SHEET-FED PRINTING PRESS AND SHEET-FED PRINTING PRESS FOR IMPLEMENTING THE METHOD

BACKGROUND OF THE INVENTION

Field of the Invention

The present invention relates to a method of operating a sheet-fed printing press that has a sheet guide module that can be removed from the sheet-fed printing press and then be inserted into the sheet-fed printing press again, and a machine control system, and further relates to just such a sheet-fed printing press for implementing the method.

German Published, Non-Prosecuted Patent Application DE 199 14 178 A1, corresponding to U.S. Pat. No. 6,135,026 to Kalbantner et al., describes a sheet-fed printing press with sheet guide modules that can be removed therefrom for cleaning or other maintenance purposes. The sheet guide modules are disposed beside a sheet transport drum and are used to guide printing material sheets transported by the sheet transport drum. If, following their maintenance, the sheet guide modules are inserted into the sheet-fed printing press again, wrong positioning of the sheet guide modules must be avoided unconditionally because, as a result of the wrong positioning of a sheet guide module, there would be the risk of a collision between the sheet guide module involved and the sheet transport drum as soon as the sheet transport drum begins to rotate. Such a collision could lead to severe machine damage. Although the sheet guide modules are associated with a device that guides them during their installation and with whose support the handling of the sheet guide modules is substantially safer than is possible without such a device, installation errors would not be ruled out absolutely by this device on its own, that is to say, without further safety measures. For such a reason, hitherto it was the tried and tested practice of the applicant and of the manufacturer of the sheet-fed printing presses described in the aforementioned published specification, which is also an invention of the present applicant, to have the maintenance work associated with the dismantling and reinstallation of the sheet guide modules carried out by fitters on behalf of the print shop. These fitters from the manufacturer are specifically trained for the dismantling and reinstallation work and are very used to it. However, there has, for a long time, been the desire on the part of the print shops to be able to allow such maintenance work to be carried out by their own operating personnel. Because the operating personnel belonging to the print shop, even if they were trained for the necessary installation work, cannot acquire the routine of the fitters who carry out the maintenance work in various print shops and, thus, much more frequently than the operating personnel of an individual print shop would do, the aforementioned applicant and manufacturer have hitherto preferred, as a safety measure, to authorize only its own fitters and not the operating personnel for the maintenance work associated with the removal and the insertion of the sheet guide modules. Although sufficient installation safety was provided in this way, it was not possible to meet the desire of the print shops to take the maintenance work into their own hands.

Neither German Published, Non-Prosecuted Patent Application DE 101 00 197 A1 nor German Published, Non-Prosecuted Patent Application DE 100 60 557 A1, corresponding to United States Patent Publication 2002/069775A1 to Knopp et al., nor German Utility Model DE 297 10 252 U1, which merely represent further prior art, were able to make an effective contribution to solving the problem outlined.

SUMMARY OF THE INVENTION

It is accordingly an object of the invention to provide a method of operating a sheet-fed printing press and sheet-fed printing press for implementing the method that overcome the hereinafore-mentioned disadvantages of the heretofore-known devices and methods of this general type and that permits safe maintenance of the sheet guide module by print shop operating personnel.

With the foregoing and other objects in view, there is provided, in accordance with the invention, a method of operating a sheet-fed printing press that has a sheet guide module that can be removed from the sheet-fed printing press and then inserted into the sheet-fed printing press again, and has a machine control system, including the steps of carrying out position monitoring of the sheet guide module with respect to its correct operating position with the machine control system, and, based upon results of the position monitoring, the machine control system keeping the sheet-fed printing press in a first operating mode when the sheet guide module is located in the correct operating position, and keeping the press in a second operating mode with at least one operating function that is restricted as compared with the first operating mode when the sheet guide module is located out of the correct operating position.

With the objects of the invention in view, there is also provided a sheet-fed printing press having a sheet guide module that can be removed from the sheet-fed printing press and then inserted into the sheet-fed printing press again, and a machine control system, and being configured to implement the method according to the invention. The press is distinguished by the fact that the machine control system is coupled to the sheet guide module in control terms such that position monitoring of the sheet guide module with respect to its correct operating position is carried out by the machine control system and, based upon results of the position monitoring, the machine control system keeps the sheet-fed printing press in a first operating mode when the sheet guide module is located in the correct operating position, and keeps the press in a second operating mode when the sheet guide module is located out of the correct operating position. The machine control system is configured such that the second operating mode is restricted with respect to at least one operating function as compared with the first operating mode.

By the invention, during the semiautomatic or, preferably, manual reinstallation of the sheet guide module, any positioning errors that may occur are detected by the machine control system. For example, the machine control system detects the fact that the operating personnel have not latched the sheet guide module into a holding device provided to hold the sheet guide module in the operating position. If such a fault is present, then the machine control system automatically restricts the operating possibilities of the sheet-fed printing press and, therefore, its functionality until the fault has been rectified and the sheet guide module is seated in its correct operating position. By such restriction of the operating possibilities, maloperation, which otherwise would lead to machine damage, is ruled out positively. Based thereupon, it is now responsibly possible to leave the maintenance and cleaning of the sheet guide module to be done by the print shop itself.

In accordance with another mode of the invention, the machine control system, which can be electrical or electronic, continuously monitors whether or not the sheet guide module is located in its operating position required for the printing operation when the sheet-fed printing press is switched on. If the first is the case, then the machine control system automatically switches into the first operating mode or it maintains the latter if it is already in the first operating mode. Otherwise, if the machine control system at a specific time detects, by sensors or by circuitry, that the sheet guide module is not yet or no longer in the required operating position, then the machine control system automatically switches into the second operating mode or maintains the second operating mode if it was already in the second operating mode at the time. The restriction of the operating function or operating functions of the second as compared with the first operating mode can be carried out in an only locally limited manner or to a locally differently great extent. The scope of the restriction can depend on the closeness or physical association between an operating point that is affected by the restriction and the potential danger area, that is to say, the direct surroundings of the sheet guide module. For example, the machine control system can grant the operating personnel more operating possibilities in the second operating mode at a first operating point that is closer to the sheet guide module or from which the surroundings of the sheet guide module and, if appropriate, the latter itself can be seen better than from a second operating point, than at the second operating point. In the first operating mode, all the operating possibilities of the second operating point can, again, be available unrestrictedly to the operating personnel so that, in the first operating mode, the machine control system enables operating possibilities equal to one another at the two operating points.

In accordance with a further feature of the invention, the sheet-fed printing press is, preferably, a rotary press and is configured to print the printing material sheets processed in it in accordance with the offset printing principle and/or to print or to varnish them in accordance with the flexographic printing principle.

In the following text, developments of the invention will be explained briefly in detail.

In accordance with an added feature of the invention, a first operating panel and a second operating panel of the sheet-fed printing press are disposed at such a distance from each other and relative to the operating position of the sheet guide module that the operating personnel can observe the immediate surroundings of the sheet guide module in the operating position and, if appropriate, the sheet guide module itself better from the first operating panel than from the second operating panel. The first operating panel is located closer to the operating position and/or the view of the operating position from the first operating panel is clearer than from the second operating panel. The operating personnel can, therefore, better monitor from the first operating panel whether the sheet guide module is located in the operating position or not and what is happening in the surroundings of the operating position, for example, how a sheet transport device that is associated with the sheet guide module moves. The machine control system is connected to the operating panels in control terms such that, in the first operating mode, the machine control system keeps both operating panels activated and that, in the second operating mode, the machine control system keeps the second operating panel at least partly deactivated. In the second operating mode, therefore, at least one operating element of the second operating panel is switched inactive by the machine control system so that no kind of reaction of the sheet-fed printing press can be initiated as a result of deliberate actuation of the temporarily stopped operating element by the operating personnel. In the second operating mode, the machine control system, preferably, sets a plurality or all of the operating elements of the second operating panel to the inactive state. The operating panels can be monitor keyboards (touch screens) or, preferably, pushbutton keyboards. Instead of the operating panels, in each case a single, multifunctional operating element, such as a joystick, can also be provided. One of the operating panels can be a central one and the other operating panel can be a decentral operating panel. In such a case, the first operating panel is, preferably, decentral and the second operating panel is central. The central operating panel can be a main control desk associated with the sheet-fed printing press for its control or a switch panel disposed at the deliverer of the sheet-fed printing press. The decentral operating panel can be one of those operating panels of which, in each case, one is disposed on each printing unit of the sheet-fed printing press. The first and second operating panels are, preferably, decentral operating panels that are disposed on various printing units of the sheet-fed printing press. For example, the first operating panel can be configured as a first operating keyboard disposed on a first printing unit, and the second operating panel can be configured as a second operating keyboard disposed on a second printing unit. The operating elements of each of the operating panels, for example, the pushbuttons of an operating keyboard, can be, but do not necessarily have to be, disposed close to one another and in a uniform grid. The operating elements can, for example, be scattered at different distances from one another on a printing unit wall.

In accordance with an additional feature of the invention, the machine control system is composed such that, for example, constructed by being programmed or in circuitry, in the second operating mode, the system keeps a greater number of operating functions deactivated on the second operating panel than on the first operating panel. For example, provision can be made for the machine control system in the second operating mode to keep active only one of a plurality of operating functions present on the first operating panel and, at the same time, to keep the second operating panel completely deactivated so that none at all of the operating functions present on the second operating panel can be initiated by the operating personnel. In the case in which, instead of the first operating panel, only a single, first operating element and, instead of the second operating panel, a single, second operating element were disposed, in the first operating mode, both the aforementioned operating elements would be kept activated by the machine control system and, in the second operating mode, the first operating element would be kept activated and the second operating element deactivated. The same is also true in the figurative sense of the one case in which, instead of the first operating panel, a single operating element is disposed and the second operating panel with its plurality of operating elements is present, and of the other case in which, instead of the second operating panel, a single operating element is disposed and the first operating panel with its plurality of operating elements is present.

In accordance with yet another mode of the invention, the machine control system in the second operating mode activates an operating function called "momentary contact operation" and also "inching mode" on the first operating panel or element and keeps it deactivated on the second operating panel or element. By the "inching mode" operating function, the operating personnel can effect stepwise advance of a motor, what is referred to as the main drive motor of the sheet-fed printing press, that drives the printing units and a sheet transport device that is associated with the sheet guide module, or a plurality of such motors that operate in parallel with one another during the setup or maintenance of the sheet-fed printing press. Each initiation of the "inching mode" operating function effected by the operating personnel by touching the appropriate operating element results in the motor or each of the motors carrying out a rotation as defined in the machine control system slowly, its rotation angle (step width) being relatively short and limited by the machine control system. In addition, the sheet transport device driven by the motor or the motors moves only over a comparatively short, limited revolution or rotation angle as a result of each single initiation of the "inching mode" operating function. To displace the sheet transport device into a phase position required for the maintenance or setup work, sometimes repeatedly successive initiation of the "inching mode" operating function, that is to say, a plurality of advance steps, may be necessary. The "inching mode" operating function can have two partial functions, namely "inch forward" and "inch backward", which can be called up as desired by the operating personnel and by which the sheet transport device can be moved in two mutually opposite advance directions (revolution or rotation directions). Two different operating elements, which are associated with the "inching mode" operating function, can be provided for the two partial functions. For instance, the sheet transport device can be a sheet transport drum and a first pushbutton can be provided in the appropriate operating panel for the "inch forward" partial function and a second pushbutton can be provided for the "inch backward" partial function. In the example given last, the operating personnel can move the motor or the motors and, therefore, the sheet transport drum by a "positive" rotation angle amounting to a few degrees in the clockwise direction by each press on the first pushbutton and, by pressing the second pushbutton, for example, for the purpose of correcting the drum alignment, move it in the counterclockwise direction by a (negative) rotation angle, likewise amounting to only a few degrees. The sheet transport device mentioned can be not only a sheet transport drum but, instead, also a chain conveyor, for example, a chain gripper deliverer, belonging to the sheet-fed printing press and circulating during printing operation.

In accordance with yet a further feature of the invention, there is provided a protective cover of the sheet-fed printing press mounted such that it can be displaced into a closed position, in which the protective cover closes a machine opening of the sheet-fed printing press. The sheet guide module can be removed from the sheet-fed printing press through the machine opening when the protective cover is in an "open" position, in which the protective cover no longer closes the machine opening. According to the development explained at this point, the machine control system is connected to the protective cover in control terms such that position monitoring of the protective cover is carried out by the machine control system and the machine control system automatically switches the sheet-fed printing press into the second operating mode as soon as the result of the position monitoring of the protective cover is that the protective cover is located out of the closed position. Opening the machine opening, therefore, necessarily entails the machine control system changing from the first to the second operating mode. As a result, when the protective cover is displaced away from the machine opening, the operator can no longer call up each of those operating functions that are otherwise ready to be called when the protective cover is displaced toward the machine opening in the first operating mode and is in its closed position. The protective cover is, preferably, constructed as a pivotably mounted protective flap, and the machine opening, preferably, extends over a sheet transport drum and substantially in the horizontal plane.

In accordance with yet an added feature of the invention, the machine control system is connected in control terms to the sheet guide module through an electric coupling used for the position monitoring of the sheet guide module, and is distinguished by the fact that the electric coupling can be assembled from a first coupling element and a second coupling element compatible therewith. According to the development described here, the first coupling element has a first electrical contact and a second electrical contact, and the second coupling element has a third electrical contact and a fourth electrical contact, a first signal line being connected to the first electrical contact and a second signal line being connected to the second electrical contact. When the two coupling elements are joined together or plugged together, the first electrical contact is in current-carrying contact with the third electrical contact, and the second electrical contact is in current-carrying contact with the fourth electrical contact. Therefore, the first and third electrical contacts together form a first electrical contact pair, and the second and fourth electrical contacts together form a second electrical contact pair. If the first coupling element is a male half coupling (plug) and the second coupling element is a female half coupling (socket or jack), then the first and second electrical contacts are plug-in pins and the third and fourth electrical contacts are plug-in sleeves. The electrical coupling, which is, thus, a four-pole plug-in connector, includes at least one further such electrical contact pair or, preferably, a plurality of further electrical contact pairs in addition to those mentioned. It is inherent in the development described here that the second coupling element is fitted to the sheet guide module and, together with the sheet guide module, is removed from the sheet-fed printing press when the coupling elements are released from one another, while the first coupling element with its signal lines remains in the sheet-fed printing press at this time. The signal lines are used for the control connection of the first coupling element to the machine control system. In addition, for the development described here, it is important that the second coupling element has a current-carrying short-circuit connecting link connecting the third electrical contact permanently to the fourth electrical contact. Such a connecting link can be, for example, a wire clamped to the third electrical contact by its one end and to the fourth electrical contact by its other end. It is, likewise, possible for the third electrical contact, the connecting link, and the fourth electrical contact to be produced from one and the same piece and form a single, for example, U-shaped, component. When the coupling elements are coupled to one another, the first signal line is short-circuited to the second signal line by the connecting link so that an electrical current, which signals to the machine control system the presence of the sheet guide module in its operating position, flows from the first signal line through the connecting link into the second signal line. If the presence of the sheet guide module in its operating position is not given, for example, because the sheet guide module has been removed from the sheet-fed printing press or because the sheet guide module has not been installed correctly in the sheet-fed printing press, then the coupling elements are not coupled to one another or, else, not coupled completely, the current-carrying contact of the first electrical contact with the third and/or that of the second with the fourth electrical contact being canceled so that the current flow from the first signal line through the connecting link into the second signal line is interrupted within the electrical coupling and the machine control system detects therefrom that the sheet guide module is not located in the correct operating position.

In accordance with yet an additional feature of the invention, the sheet guide module is disposed substantially underneath a sheet transport drum, and the sheet guide module is curved such that it extends longitudinally substantially equidistantly from a circumferential line or a gripper flight circle of the sheet transport drum. The sheet guide module associated with the sheet transport drum in the immediate vicinity of the sheet transport drum is used to guide the printing material sheets transported by the sheet transport drum during their transport and can extend into the region of one of the two upper quadrants of the sheet transport drum, but only to a low extent and, thus, to an insubstantial degree. In any case, the predominant part of the sheet guide module is located underneath the sheet transport drum. The front and/or rear region close to the edge of the sheet guide module, as viewed in the sheet transport direction, can be curved away from the sheet transport drum. As such, what is referred to as the sheet entry zone of the sheet guide module at the rear edge and/or what is referred to as the sheet exit zone at the front edge can be configured so as to be curved gently in an S shape. A guide zone of the sheet guide module, located between the entry zone and the exit zone, which is substantially larger than the two aforementioned edge zones, in any case runs concentrically with the circumferential line or the gripper flight circle of the sheet transport drum.

In accordance with again another feature of the invention, the sheet-fed printing press can include impression cylinders mounted at the same height as one another and the sheet transport drum, already mentioned many times, mounted offset vertically relative to the impression cylinders. The mid-axis and axis of rotation of the sheet transport drum mounted between the impression cylinders is, preferably, located at a lower vertical level than the mid-axes and axes of rotation of the impression cylinders. The sheet transport drum can be one of a plurality of, preferably, multiple-sized (double-sized, etc.) sheet transport drums belonging to the sheet-fed printing press that, as viewed in the sheet transport direction, are disposed alternately with the impression cylinders such that one of the sheet transport drums immediately follows each of the impression cylinders and that a horizontal line on which the centers or mid-axes of the sheet transport drums lie is lower than a horizontal line on which the centers or mid-axes of the impression cylinders lie, and that a common center connecting line on which the centers of the aforementioned sheet transport drums and impression cylinders lie runs in a zigzag shape on account of the center positions.

In accordance with again a further feature of the invention, the press has impression cylinders mounted at the same height as one another and a sheet transport drum mounted between the impression cylinders and offset vertically relative to the impression cylinders, and the sheet guide module is disposed in an immediate vicinity of the sheet transport drum.

In accordance with again an added feature of the invention, the sheet transport drum has a drum profile that is elongate and, thus, differs substantially from the circular shape. Such a drum profile can be substantially oval or substantially rhomboidal. This development also includes a sheet transport drum in which the drum profile deviates substantially from the circular shape only in a specific profile setting. Such a sheet transport drum can also be designated a vario drum and has a variable drum profile that, for example, can be set substantially circularly for paper sheet transport and can be set so as to deviate substantially from the circular shape, for example, oval, for board sheet transport.

In accordance with a concomitant feature of the invention, the sheet guide module includes blown air and/or vacuum nozzles and at least one fan (ventilator) for supplying these nozzles with the blown air and/or vacuum.

Other features that are considered as characteristic for the invention are set forth in the appended claims.

Although the invention is illustrated and described herein as embodied in a method of operating a sheet-fed printing press and sheet-fed printing press for implementing the method, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
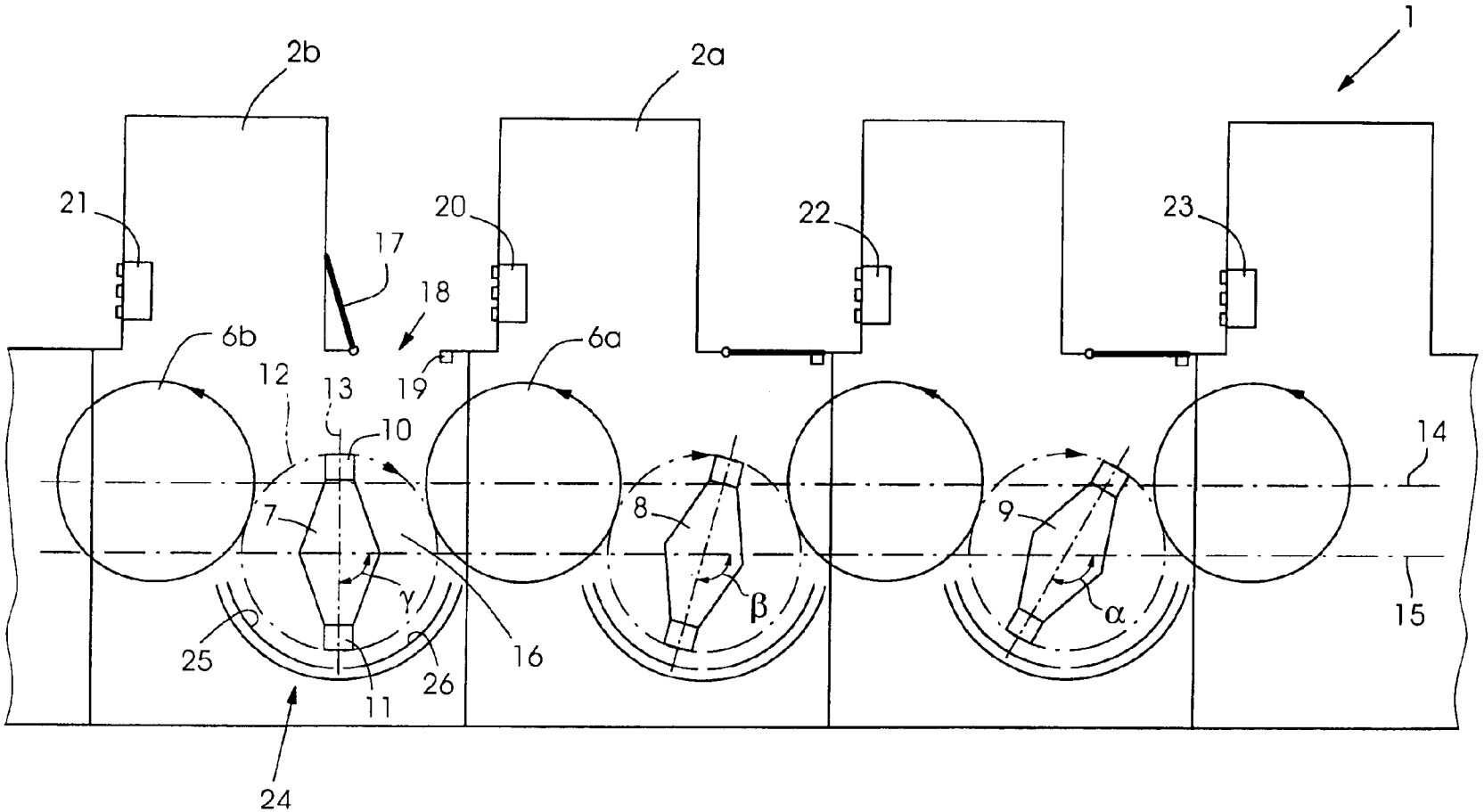
FIG. 1 is a fragmentary, diagrammatic, cross-sectional view of a sheet-fed printing press according to the invention.

Referring now to the figures of the drawings in detail and first, particularly to FIG. 1 thereof, there is shown a sheet-fed printing press 1 with printing units 2*a*, 2*b* disposed in line, each having an impression cylinder 6*a* and 6*b*, respectively. Disposed alternately with the impression cylinders 6*a*, 6*b* are a first sheet transport drum 7, a second sheet transport drum 8, and a third sheet transport drum 9. Each of the sheet transport drums 7, 8, 9 has a first gripper system 10 and, disposed diametrically opposite thereto, a second gripper system 11 for holding sheets to be printed in the sheet-fed printing press 1. The gripper systems 10, 11 move along a gripper flight circle 12 when the corresponding sheet transport drum 7, 8 or 9 rotates. The drum profile of each sheet transport drum 7, 8, 9 extends between the gripper systems 10, 11 along a drum profile longitudinal axis 13 set back from the gripper flight circle 12 so that on both sides of the drum profile there is in each case a substantially sickle-shaped clearance 16 between the corresponding sheet transport drum and its gripper flight circle 12.

A cylinder center connecting line 14, on which the impression cylinders 6*a*, 6*b* lie with their centers, runs above a drum center connecting line 15 of the sheet transport drums 7, 8, 9. With regard to their rotation angle positions, the sheet transport drums 7, 8, 9 are always aligned offset in relation to one another such that between two successive sheet transport drums 7, 8 or 8, 9 there is a specific rotation angle difference, the upstream sheet transport drum in the sheet transport direction leading the downstream one with regard to the rotation angle position assumed. Between drum rotation angles α and β of the sheet transport drums 8, 9 there is, with regard to angle magnitude and sign, the same rotation angle difference as between drum rotation angles β and γ of the sheet transport drums 7, 8.

Above each sheet transport drum 7, 8, 9 there is in each case a machine opening 18 and a protective cover 17 to close the opening 18. The protective cover 17 is associated with a sensor 19, for example, an electric feeler, which monitors whether the protective cover 17 is closed properly or not. Underneath each sheet transport drum 7, 8, 9 there is in each case a sheet guide device 24 having a first sheet guide module 25 and a second sheet guide module 26. A first operating panel 20, a second operating panel 21, a third operating panel 22, and a fourth operating panel 23 are located on another printing unit in each case.

During operation of the sheet-fed printing press 1, carried out from the first operating panel 20 and through the latter with the protective cover 17 open, the operating personnel can see and monitor the first sheet transfer drum 7 and the sheet guide device 24 much better through the machine opening 18 than would be possible during operation carried out from the second, third, or fourth operating panel.

Figure 2:
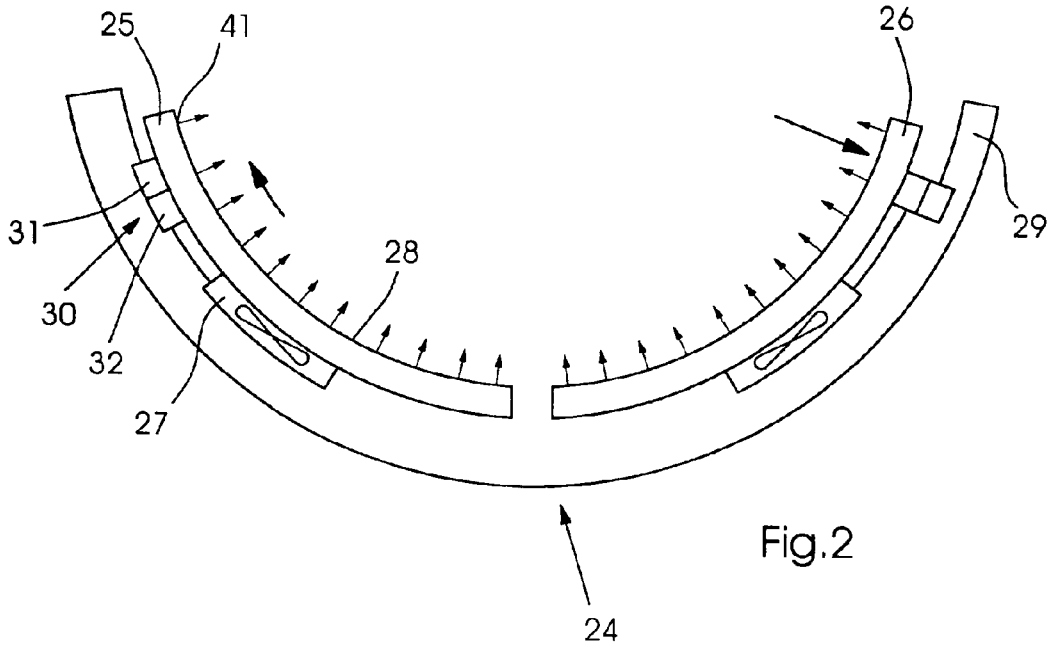
FIG. 2 is a diagrammatic, cross-sectional view of a sheet guide device of the sheet-fed printing press of FIG. 1.

FIG. 2 shows that the sheet guide device 24 includes an installation device 29 that, during the reinsertion of the sheet guide modules 25, 26, guides the latter into their correct operating position and then keeps them in their correct operating position. In addition, it is shown that each of the sheet guide modules 25, 26 has a nozzle area 28 with nozzles 41 and a fan 27 for supplying the nozzles 41 with a vacuum and/or blown air. Each fan 27 is fitted underneath the nozzle area 28 on its respective sheet guide module 25 or 26 and, together with the sheet guide module, of which the fan is a constituent part, can be removed from time to time from the sheet-fed printing press 1, for example, when the nozzle area 28 is to be freed outside the sheet-fed printing press 1 of contamination as a result of smeared printing ink and paper dust. In each case, an electrical coupling 30 is associated with the sheet guide modules 25, 26.

Figure 4:
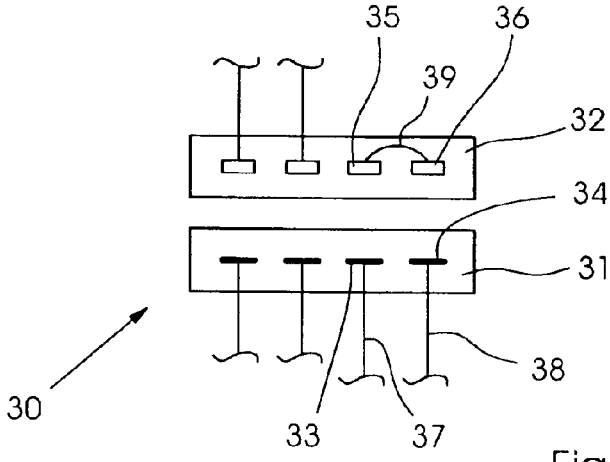
FIG. 4 is a fragmentary, block circuit diagram of an electric coupling of the control structure for monitoring the position of the sheet guide device of FIG. 2.

FIG. 4 shows, by way of example, that the electrical coupling 30 associated with the first sheet guide module 25 includes a first coupling element 31 and a second coupling element 32. The first coupling element 31 has a first electrical contact 33 and a second electrical contact 34 and is permanently fitted to the installation device 29, that is to say, fixed to the machine. A first signal line 37 is connected to the first electrical contact 33, and a second signal line 38 is connected to the second electrical contact 34. The second coupling element 32 has a third electrical contact 35 and a fourth electrical contact 36 and a connecting link 39 connecting the third 35 to the fourth 36 electrical contact. The second coupling element 32 is permanently fitted to the first sheet guide module 25.

Figure 3:
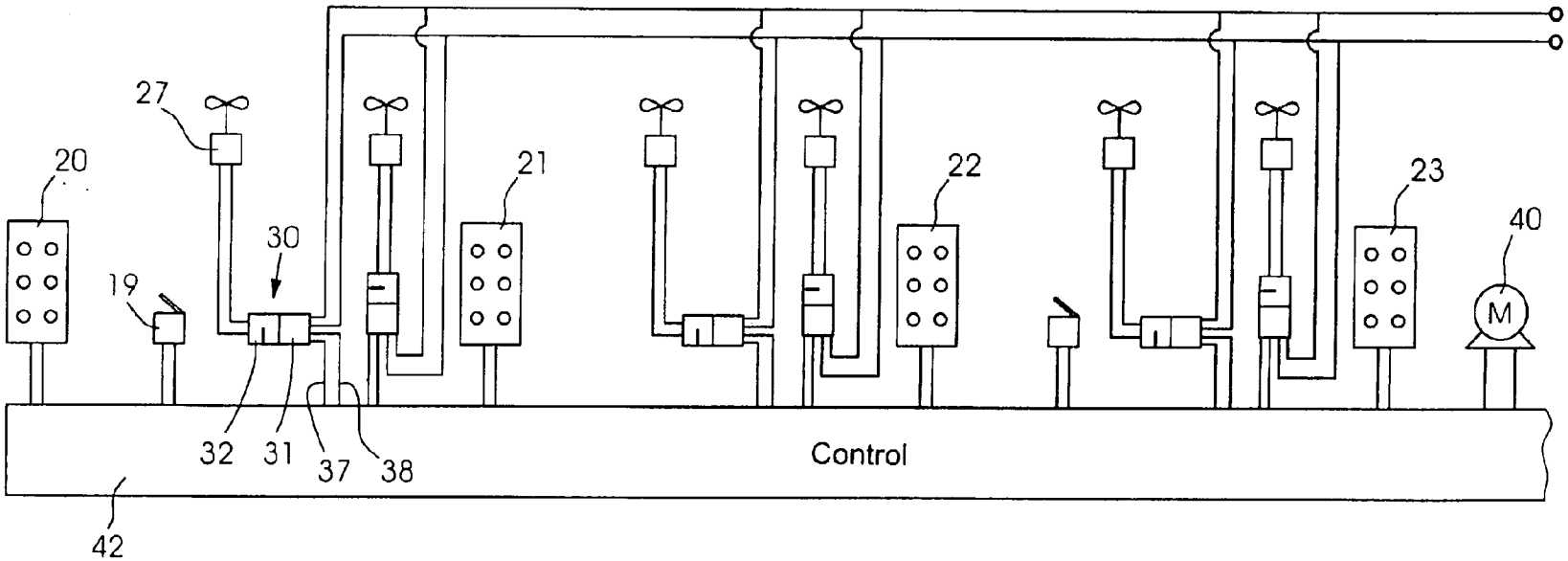
FIG. 3 is a fragmentary block circuit diagram of a control structure of the sheet-fed printing press of FIG. 1.

FIG. 3 shows that the operating panels 20, 21, 22, 23, the sensor 19, a main drive motor 40 driving the sheet transport drums 7, 8, 9 in rotation and, by the signal lines 37, 38, the first coupling element 31, are connected to a machine control system 42.

The electrical safeguarding of the sheet guide modules 25, 26 associated with the first sheet transport drum 7 and the sheet guide modules associated with the other two sheet transport drums 8, 9 will be explained below using the example of the first sheet guide module 25.

The electrical safeguarding is carried out by the machine control system 42 interrogating the position of the first sheet guide module 25 by the electrical coupling 30. In the event of an improper position of the first sheet guide module 25, the coupling elements 31, 32 are necessarily at least partly separated from one another so that the mutually associated electrical contacts 33, 35 and/or the mutually associated electrical contacts 34, 36 are separated from one another and, consequently, the current flow in the electrical coupling 30 is interrupted between the signal lines 37, 38. This interruption to the current flow is a signal, that indicates, from the machine control system 42, that the first sheet guide module 25 is located out of its intended operating position required for printing operation. The signal interpretation leads to the machine control system 42 switching over the sheet-fed printing press 1 from a first operating mode into a second operating mode.

The second operating mode is distinguished by the fact that the machine control system 42, firstly, by an optical or acoustic warning signal, points out the hazardous situation to the operating personnel and, secondly, at the same time, prevents specific movements of the sheet-fed printing press 1. For example, the warning signal can appear on a display of a non-illustrated central main control desk of the sheet-fed printing press 1 or can be a flashing light or a flashing key on the printing unit 2*a*, 2*b*, . . . affected by the damage or the removal of the sheet guide module. Which movements of the sheet-fed printing press 1 that are prevented by the machine control system 42 in the second operating mode depends on whether the protective cover 17 is open or closed.

If the sensor 19 signals to the machine control system 42 that the protective cover 17 is closed, then none of the operating panels 20, 21, 22, 23 can be used to start the main drive motor 40 and, thus, to set the first sheet transport drum 7 rotating. The first sheet transport drum 7 is, therefore, the subject of a total movement ban.

Otherwise, if, in the second operating mode, the sensor 19 signals to the machine control system 42 that the protective cover 17 is open, the machine control system 42 sets the operating panels 21, 22, 23 into a "dead" state, in which the main drive motor 40 can no longer be operated at all, and, thus, the first sheet transport drum 7 can no longer be set rotating, from these operating panels 21, 22, 23. The operating personnel can, thus, work without any danger in the region of the first sheet transport drum 7, for example, to move the first sheet guide module 25 into its proper operating position again or to remove the first sheet guide module 25 from the sheet-fed printing press 1 through the clearance 16 and the machine opening 18 for maintenance or cleaning purposes. Another person who does not know about the dangerous situation associated with the mounting work can in no way set the first sheet transport drum 7 rotating through the operating panels 21, 22, 23.

As opposed to the operating panels 21, 22, 23, the first operating panel 20, which is located in the tangible vicinity of the operating personnel handling the first sheet guide module 25, is not set completely "dead" by the machine control system 42. This is because the operating personnel, before and during the mounting work relating to the first sheet guide module 25, need to be able to drive the sheet-fed printing press 1 in the inching mode. For example, by inching the main drive motor 40 forward and back, the operating personnel need to displace the first sheet transport drum 7 into its rotation angle position illustrated in FIG. 1, in which the drum profile longitudinal axis 13 is aligned substantially vertically so that, first of all, the second sheet guide module 26 and, then, the first sheet guide module 25 can be removed one after another from the sheet-fed printing press 1 through the clearance, designated by the designation 16, between the first sheet transport drum 7 and the upstream impression cylinder 6*a*. Therefore, the machine control system 42 keeps only the operating possibility "inching mode" open on the first operating panel 20, and exclusively only on the first operating panel 20, and keeps other operating possibilities, likewise open in the first operating mode, no longer open in the second operating mode. Therefore, only the intrinsically safe operating possibility "inching mode" is still available to the operating personnel, and also only within the visible range of the danger point on site.

In a departure from what has been explained previously, it is also possible that, on the first operating panel 20, beyond the operating element required for the inching mode or the operating elements required for this, a further operating element can be operated in the second operating mode. This further operating element is used to acknowledge to the machine control system 42 that the sheet guide modules 25, 26 have been removed completely from the sheet-fed printing press 1.

Such an electronic acknowledgement is important in the following connection: it is necessary for not only the sheet guide modules 25, 26 of the printing unit 2*b* but also the sheet guide modules of the other printing units to be removed successively from the sheet-fed printing press 1. As long as the drum profile longitudinal axis 13 of the first sheet transport drum 7 is still in its vertical position, the drum profile longitudinal axis of the second sheet transport drum 8 is necessarily not yet in this vertical alignment, but must be set in order to be able to remove the sheet guide modules associated with the second sheet transport drum 8 from the sheet-fed printing press 1. The dismantling of all the sheet guide modules associated with the sheet transport drums 7, 8, 9 specifically requires that, following the conclusion of the dismantling work in a printing unit and before the start of the dismantling work in the following printing unit, its sheet transport drums must be rotated into the dismantling position shown in FIG. 1 using the example of the first sheet transport drums 7. Because of the different angles $\alpha$, $\beta$, $\gamma$, it is not possible to align the drum profile longitudinal axes of all the sheet transport drums 7, 8, 9 vertically at the same time. After the sheet guide modules have been removed from the respective printing units, the aforementioned acknowledgement of the sheet guide module removal is carried out individually for each printing unit on the operating panel 20, 22, or 23 closest to the respective sheet transport drum 7, 8, and 9.

The storage of such an acknowledgement in the machine control system 42 can be demanded again by the machine control system 42 at each new start of the sheet-fed printing press 1, the machine control system 42 assuming a change in the operating personnel. Under certain circumstances, it is expedient to store the acknowledgement in the machine control system 42 not only from time to time but, moreover, also in a permanent memory.

The operating elements required for the acknowledgements could also all be located on a central control desk instead of on the operating panels 20, 22 and 23.

The result of the acknowledgement is that the sheet-fed printing press 1 can, now, be operated in what is referred to as creep mode even with the sheet guide modules removed, that is to say, including for the purpose of being able to perform automated processes such as cleaning of inking units, of the impression cylinders and of the blanket cylinders or, else, a printing plate change. In specific cases, it is even conceivable for the sheet-fed printing press 1 to achieve its unrestricted functionality or its functionality unrestricted with the exception of the function "sheet feed on" following the acknowledgements.

As illustrated pictorially in FIGS. 3 and 4, the coupling elements 31, 32 include still further electrical contacts, which are used to couple the fan 27 to a power supply, in addition to the electrical contacts 33, 34, 35, 36.

In a departure from the exemplary embodiment illustrated pictorially, instead of the electrical coupling 30, use can also be made of another sensor that detects whether the sheet guide model 25 is located in the correct operating position or not.

We claim:

1. A method of operating a sheet-fed printing press having a removable sheet guide module, able to be removed from the press and then inserted back into the press again, and a machine control system, which comprises:

monitoring a position of the sheet guide module with respect to a correct operating position with the machine control system;

based upon results of the position monitoring, the machine control system:

keeping the press in a first operating mode when the sheet guide module is in the correct operating position; and keeping the press in a second operating mode with at least one operating function restricted as compared with the first operating mode when the sheet guide module is out of the correct operating position.

2. The method according to claim 1, which further comprises:

in the first operating mode, the machine control system keeping activated:

a first operating panel from which the immediate surroundings of the sheet guide module can be seen better than from a second operating panel; and the second operating panel; and in the second operating mode, the machine control system keeping the second operating panel at least partly deactivated.

3. The method according to claim 2, which further comprises, in the second operating mode, the machine control system keeping deactivated:

a first number of operating functions of the first operating panel; and a second number of operating functions of the second operating panel greater than the first number.

4. The method according to claim 2, which further comprises, in the second operating mode, the machine control system keeping an inching mode operating function activated on the first operating panel and keeping the inching mode deactivated on the second operating panel.

5. The method according to claim 3, which further comprises, in the second operating mode, the machine control system keeping an inching mode operating function activated on the first operating panel and keeping the inching mode deactivated on the second operating panel.

6. The method according to claim 1, wherein the press has a machine opening used to remove the sheet guide module and a protective cover displaceable into a closed position to close the machine opening and which further comprises:

carrying out position monitoring of the cover with respect to the closed position with the machine control system; and automatically switching over the sheet-fed printing press with the machine control system into the second operating mode when a result of the position monitoring of the cover is an indication that the protective cover is not in the closed position.

7. The method according to claim 1, which further comprises:

monitoring the position of the sheet guide module with an electrical coupling having:

a first coupling half having a first electrical contact and a second electrical contact; and a second coupling half fixed to the sheet guide module and having a third electrical contact for electrically contacting the first electrical contact, a fourth electrical contact for electrically contacting the second electrical contact, and a current-carrying connecting link connecting the third electrical contact to the fourth electrical contact; and connecting a first signal line to the first electrical contact and to the control system; and connecting a second signal line to the second electrical contact and to the control system.

8. The method according to claim 2, which further comprises providing the first operating panel as a first operating keyboard disposed on a printing unit of the press and the second operating panel as a second operating keyboard disposed on another printing unit of the press.

9. The method according to claim 1, which further comprises disposing the sheet guide module substantially underneath a sheet transport drum of the press, the sheet guide module extending in a curved manner substantially concentrically with the sheet transport drum.

10. The method according to claim 1, which further comprises:

mounting impression cylinders in the press at the same mutual height;

mounting a sheet transport drum between the impression cylinders offset vertically with respect to the impression cylinders; and providing the sheet guide module in an immediate vicinity of the sheet transport drum.

11. The method according to claim 9, which further comprises providing the sheet transport drum with an elongate drum profile different from a circular shape.

12. The method according to claim 10, which further comprises providing the sheet transport drum with an elongate drum profile different from a circular shape.

13. The method according to claim 9, which further comprises providing the sheet transport drum with an elongate drum profile substantially different from a circular shape.

14. The method according to claim 10, which further comprises providing the sheet transport drum with an elongate drum profile substantially different from a circular shape.

15. The method according to claim 1, which further comprises providing the sheet guide module with nozzles and a fan pneumatically acting on the nozzles.

16. In a sheet-fed printing press having operating functions and at least first and second operating modes, a control device comprising:

a removable sheet guide module having a correct operating position and being able to be removed from the press and then inserted back into the press again;

a machine control system connected to said sheet guide module in control terms to monitor a position of said sheet guide module with respect to said correct operating position and, based upon results of the position monitoring, said control system:

keeping the press in the first operating mode when said sheet guide module is in said correct operating position; and keeping the press in the second operating mode when said sheet guide module out of said correct operating position; and being configured to restrict the second operating mode with respect to at least one operating function as compared with the first operating mode.

17. The sheet-fed printing press according to claim 16, wherein:

the press has first and second operating panels disposed at a distance from one another such that immediate surroundings of said sheet guide module can be seen better from the first operating panel than from the second operating panel; and said control system is linked to the operating panels in control terms to:

keep the first operating panel and the second operating panel activated in the first operating mode; and keep the second operating panel at least partly deactivated in the second operating mode.

18. The sheet-fed printing press according to claim 17, wherein:

the first operating panel has operating functions;

the second operating panel has operating functions; and in the second operating mode, said control system deactivates:

a first number of the operating functions of the first operating panel; and a second number of the operating functions of the second operating panel greater than the first number.

19. The sheet-fed printing press according to claim 17, wherein, in the second operating mode, said control system activates an inching mode operating function on the first operating panel and deactivates the inching mode operating function on the second operating panel.

20. The sheet-fed printing press according to claim 18, wherein, in the second operating mode, said control system activates an inching mode operating function on the first operating panel and deactivates the inching mode operating function on the second operating panel.

21. The sheet-fed printing press according to claim 16, further comprising:

a machine opening for removing said sheet guide module;

a protective cover displaceably mounted at said opening to close said machine opening in a closed position of said cover;

said control system is coupled to said protective cover to monitor a position of said protective cover with respect to said closed position;

said control system automatically switches the press into the second operating mode when a result of the position monitoring of said protective cover is that said protective cover is out of said closed position.

22. The sheet-fed printing press according to claim 16, further comprising:

first and second signal lines connected to said control system; and an electrical coupling having:

a first coupling half having:

a first electrical contact electrically connected to said first signal line; and a second electrical contact electrically connected to said second signal line;

a second coupling half fixed to said sheet guide module and having:

a third electrical contact for contacting said first electrical contact;

a fourth electrical contact for contacting said second electrical contact; and a current-carrying connecting link connecting said third electrical contact to said fourth electrical contact; and said electrical coupling coupling said control system to said sheet guide module in control terms such that said control system utilizes said electrical coupling for the position monitoring of said sheet guide module.

23. The sheet-fed printing press according to claim 17, wherein:

the press has printing units; and the first operating panel is a first operating keyboard disposed on one of the printing units and the second operating panel is a second operating keyboard disposed on another one of the printing units.

24. The sheet-fed printing press according to claim 16, wherein:

the press has a sheet transport drum; and said sheet guide module is disposed substantially underneath the sheet transport drum and extends in a curved manner substantially concentrically with the sheet transport drum.

25. The sheet-fed printing press according to claim 16, wherein:

the press has:

impression cylinders mounted at the same height as one another; and a sheet transport drum mounted between the impression cylinders and offset vertically relative to the impression cylinders; and said sheet guide module is disposed in an immediate vicinity of the sheet transport drum.

26. The sheet-fed printing press according to claim 24, wherein the sheet transport drum has an elongate drum profile different from a circular shape.

27. The sheet-fed printing press according to claim 25, wherein the sheet transport drum has an elongate drum profile different from a circular shape.

28. The sheet-fed printing press according to claim 24, wherein the sheet transport drum has an elongate drum profile substantially different from a circular shape.

29. The sheet-fed printing press according to claim 25, wherein the sheet transport drum has an elongate drum profile substantially different from a circular shape.

30. The sheet-fed printing press according to claim 16, wherein said sheet guide module has:

nozzles; and a fan fluidically connected to said nozzles for pneumatically acting on said nozzles.

* * * * *